US006561828B2

(12) United States Patent
Henrici et al.

(10) Patent No.: US 6,561,828 B2
(45) Date of Patent: May 13, 2003

(54) FLUORESCENT-LAMP SOCKET

(75) Inventors: Dieter Henrici, Arnsberg (DE); Hartmut Greschner, Arnsberg (DE); Wolfgang Standop, Hamm (DE)

(73) Assignee: Brokelmann, Jaeger & Busse, GmbH & Co., Arnsberg (DE)

( * ) Notice: Subject to any disclaimer, the term of this patent is extended or adjusted under 35 U.S.C. 154(b) by 0 days.

(21) Appl. No.: 09/974,699

(22) Filed: Oct. 10, 2001

(65) Prior Publication Data

US 2003/0068913 A1 Apr. 10, 2003

(51) Int. Cl.[7] ..... H01R 33/02

(52) U.S. Cl. ..... 439/239

(58) Field of Search ..... 439/239, 231, 439/241, 244, 243, 242, 226, 229, 221, 240

(56) References Cited

U.S. PATENT DOCUMENTS 4,198,109 A * 4/1980 Ustin ..... 439/239

* cited by examiner

*Primary Examiner*—Renee Luebke
*Assistant Examiner*—Phuongchi Nguyen
(74) *Attorney, Agent, or Firm*—Herbert Dubno; Andrew Wilford

(57) ABSTRACT

A fluorescent-lamp socket has a hollow dielectric housing, and a pair of identical conductive contact elements in the housing, each contact element is unitarily formed with an outer lamp-contacting end adapted to engage a respective pin of the lamp, an inner wiring end formed as a wire-engaging clip, a center part extending between the respective inner and outer ends, and an elastic tongue unitarily formed with the respective center part and projecting transversely toward the other contact element. The contact elements are formed of resilient sheet metal. The housing can include a web projecting between and holding apart the elastic tongues. Alternately it can be constructed such that either the tongues bear on each other and electrically interconnect the contact elements or each tongue bears on the center part of the other contact element to electrically interconnect the contact elements.

7 Claims, 7 Drawing Sheets

FLUORESCENT-LAMP SOCKET

FIELD OF THE INVENTION

The present invention relates to fluorescent-lamp socket. More particularly this invention concerns such a socket for an instant-start fluorescent lamp.

BACKGROUND OF THE INVENTION

A preheat-type fluorescent lamp has two conductor pins extending from each end between which are connected resistance-wire heater coils serving to heat electrodes each connected to one of the respective pins to initiate fluorescence the hearers in the bulb are heated briefly and then an arc is drawn between the two electrodes, whereupon the voltage differential across the pins at each end is eliminated to deenergize the heater coils. Thus the lamp is fitted at each end into a socket which allows individual connections to be made to the two pins. This is the standard system for starter-type and rapid-start fluorescent lighting fixtures.

Normally as described in German patent 195 11 887 each socket comprises a hollow dielectric housing and a pair of generally identical conductive contact elements in the housing each having an outer end adapted to engage a respective pin of the lamp, an inner end formed with a wire-engaging clip, and a center part extending between the respective inner and outer ends. Wires are shoved into holes in the housing so that their ends can be fitted to the clips to make the necessary connections.

In the newer instant-start systems no starter is employed. Instead, fluorescence is initiated by applying a very high startup voltage between the ends of the lamp. Once the lamp starts to fluoresce, the voltage is dropped to the standard running voltage. Such lamps are normally made physically the same as standard starter-type lamps so that users familiar with installing the old preheat lamps have no problems. The sockets, however have to be wired differently. More particularly for an instant-start lamp both contact elements of each socket are wired together, that is there is no voltage difference across them at any time and in fact the same voltage must be applied to both of them.

In order to reduce manufacturing costs the sockets are built basically the same for both types of lamps. A simple shunt wire is installed between the clips of the two contact elements for an instant-start lamp, but is left out for the preheat-type lamps. Since each contact element is normally formed with two such clips, this still leaves two clips free for wiring of the socket. The disadvantage of this system is that installing this extra bridge wire entails an extra production step and therefore elevates cost. Furthermore if it is not installed perfectly, the socket is defective and this defect will not be discovered until the end user tries to use the fixture incorporating it.

Accordingly it has been suggested to mount a separate bridge element in the housing of the socket so that, when the two contact elements are installed they will engage it and it will electrically interconnect them. Once again, this extra structure and the extra manufacturing step installing it increases the cost of this mass-production item excessively.

OBJECTS OF THE INVENTION

It is therefore an object of the present invention to provide an improved socket for an instant-start fluorescent lamp.

Another object is the provision of such an improved socket for an instant-start fluorescent lamp which overcomes the above-given disadvantages, that is which is of very simple construction and that is no more expensive or difficult to make than a socket for a preheat-type lamp.

A further object is to provide a conductor element for a fluorescent-lamp socket that can readily be adapted for use with preheat or instant-start lamps.

SUMMARY OF THE INVENTION

A fluorescent-lamp socket has according to the invention a hollow dielectric housing, and a pair of identical conductive contact elements in the housing, each contact element is unitarily formed with an outer lamp-contacting end adapted to engage a respective pin of the lamp, an inner wiring end formed as a, wire-engaging clip, a center part extending between the respective inner and outer ends, and an elastic tongue unitarily formed with the respective center part and projecting transversely toward the other contact element.

According to the invention the contact elements are formed of resilient sheet metal. The housing can include a web projecting between and holding apart the elastic tongues. Alternately it can be constructed such that either the tongues bear on each other and electrically interconnect the contact elements or each tongue bears on the center part of the other contact element to electrically interconnect the contact elements.

Thus with the system of this invention it is possible to use exactly the same conductor elements to make sockets both for preheat-type and instant-start fluorescent lamps. Only one of two parts of a cheap molded housing needs be changed in order for the socket to accommodate the other type of lamp. As a result manufacture costs can be held quite low.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
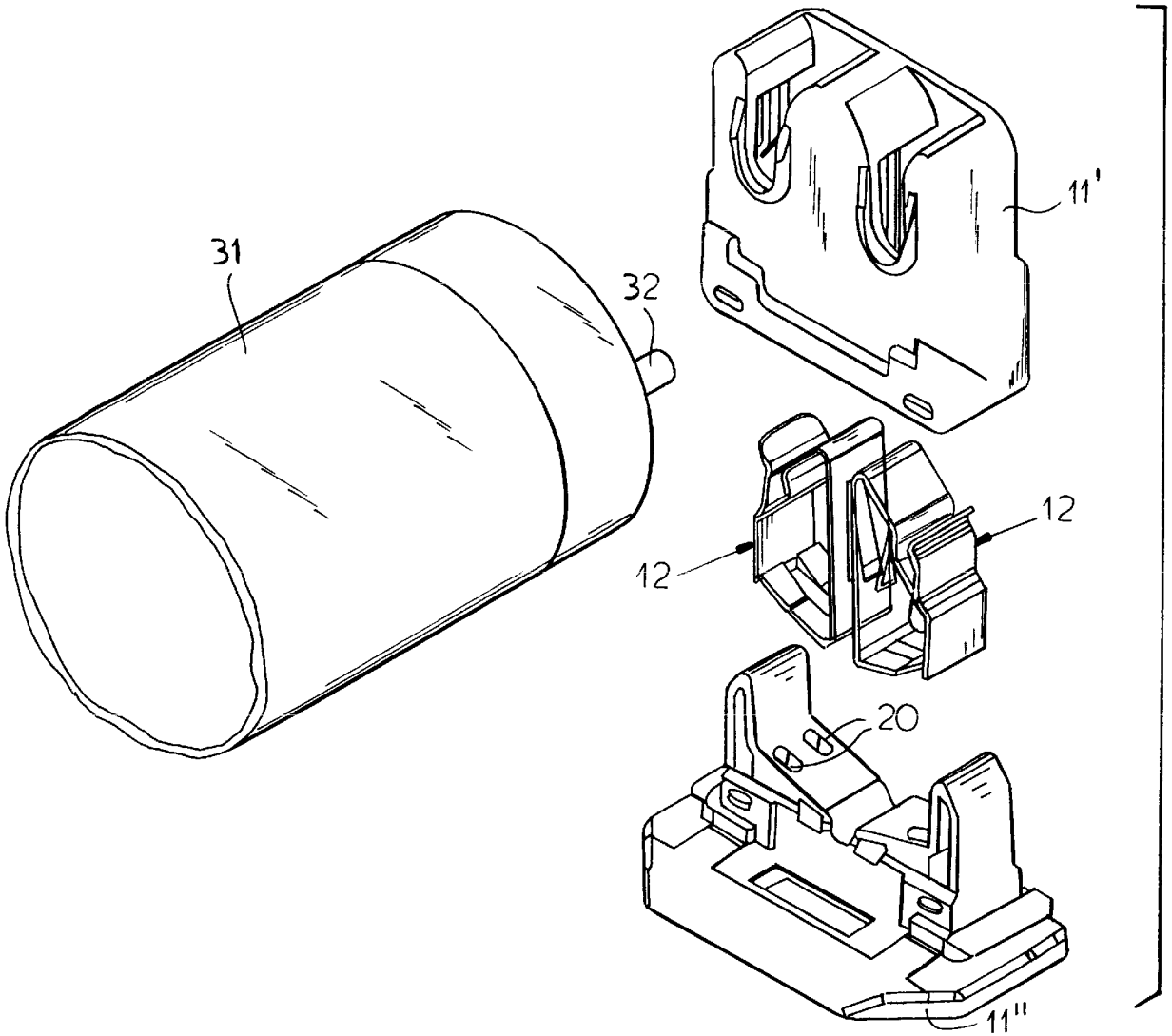
FIG. 1 is an exploded perspective view of an instant-start lamp and its socket according to the invention.
Figure 2:
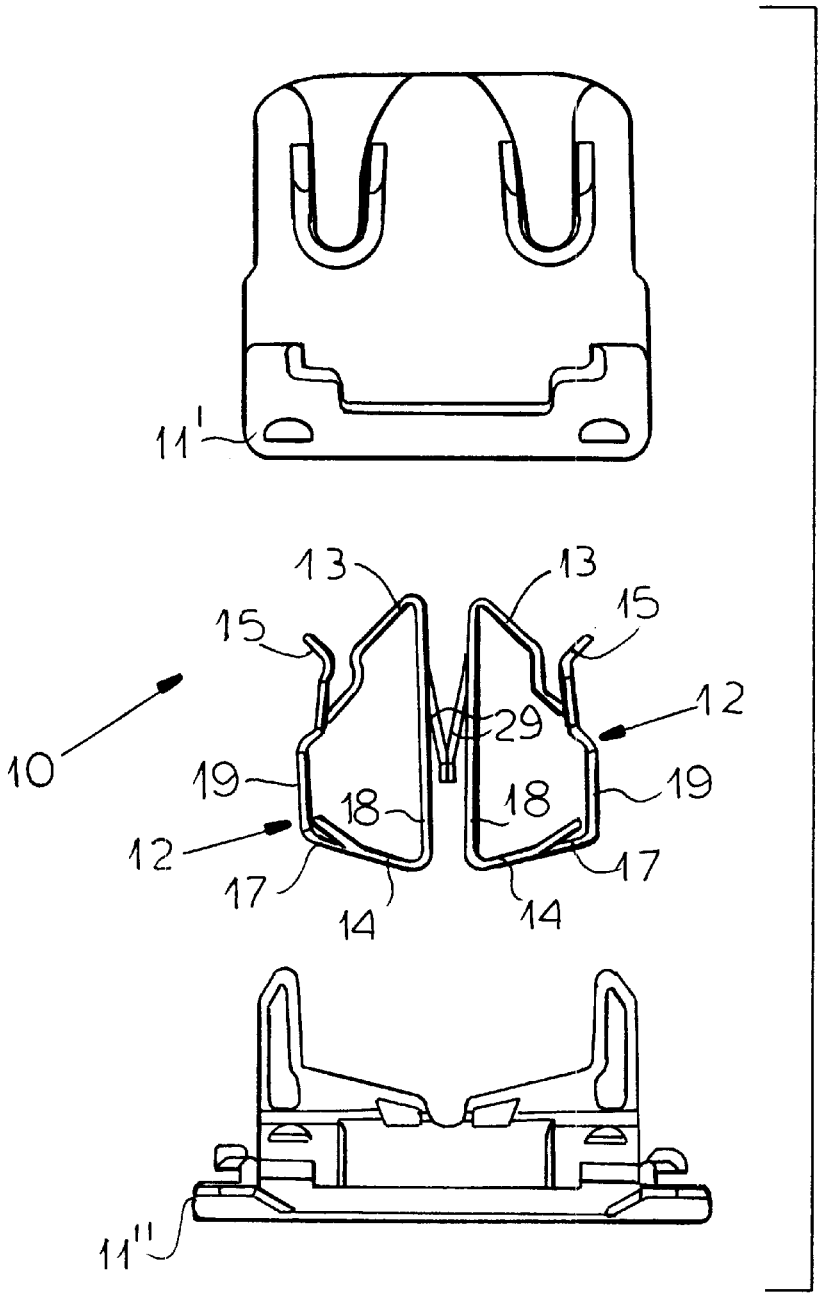
FIG. 2 is an exploded end view of the socket of FIG. 1.
Figure 3:
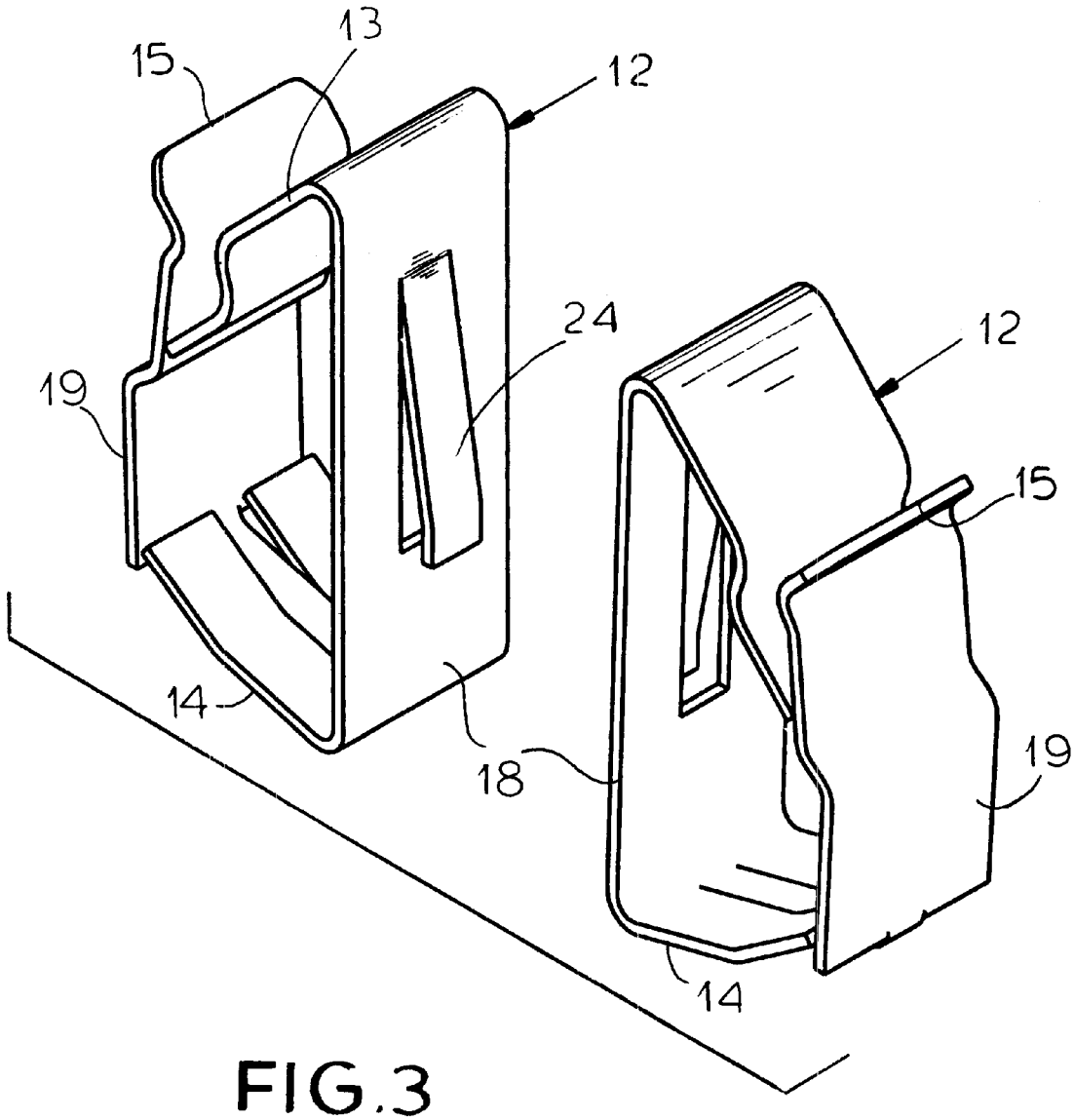
FIG. 3 is a perspective view of the contact elements of the socket in accordance with the invention.

As seen in FIGS. 1, 2, 4, and 5 a socket 10 for an unillustrated instant-start fluorescent lamp has a hollow housing or body 11 made of two interfitting parts 11' and 11" of a dielectric, normally a stiff plastic, and provided internally with a pair of identical contact elements 12 made of conductive metal, normally copper-coated sheet steel. Each contact element 12 comprises outer parts 13 and 15 that engage one of the contact pins 30 of a lamp 31 and a lower portion or clip 14 adapted to engage the conductor of an unillustrated supply wire. Center body parts 18 and 19 connect the clip to the end parts 13 and 15.

More specifically the lower portions 14 each form a pair of holes 16 (FIG. 5) through which a wire is shoved to engage bent-up spring tabs 17 of the respective clip 14 that holds the wire in good mechanical and electrical contact with the flat center body parts 19 extending between the clip portions 14 and the outer portions 13 and 15 of the respective element 12. Thus entire contact element 12 is in good electrical contact with the respective wire or wires. The upper housing part 11' has an open lower end through which during manufacture the two elements 12 are inserted and which is normally closed by the lower part 11" which is formed with throughgoing holes 20 aligned with the holes 16 of the elements 12.

Figure 4:
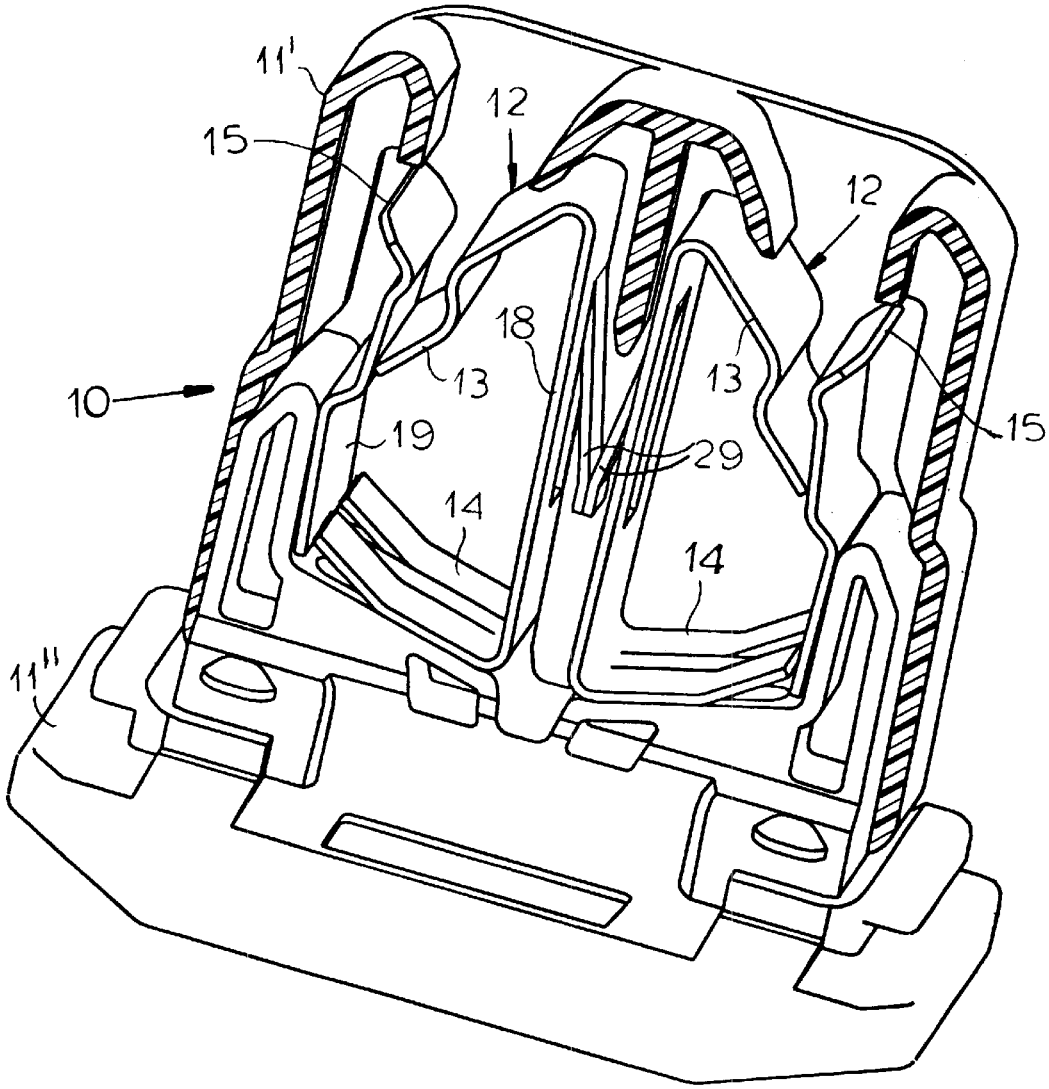
FIG. 4 is a sectional perspective view of the socket of FIG. 1.
Figure 5:
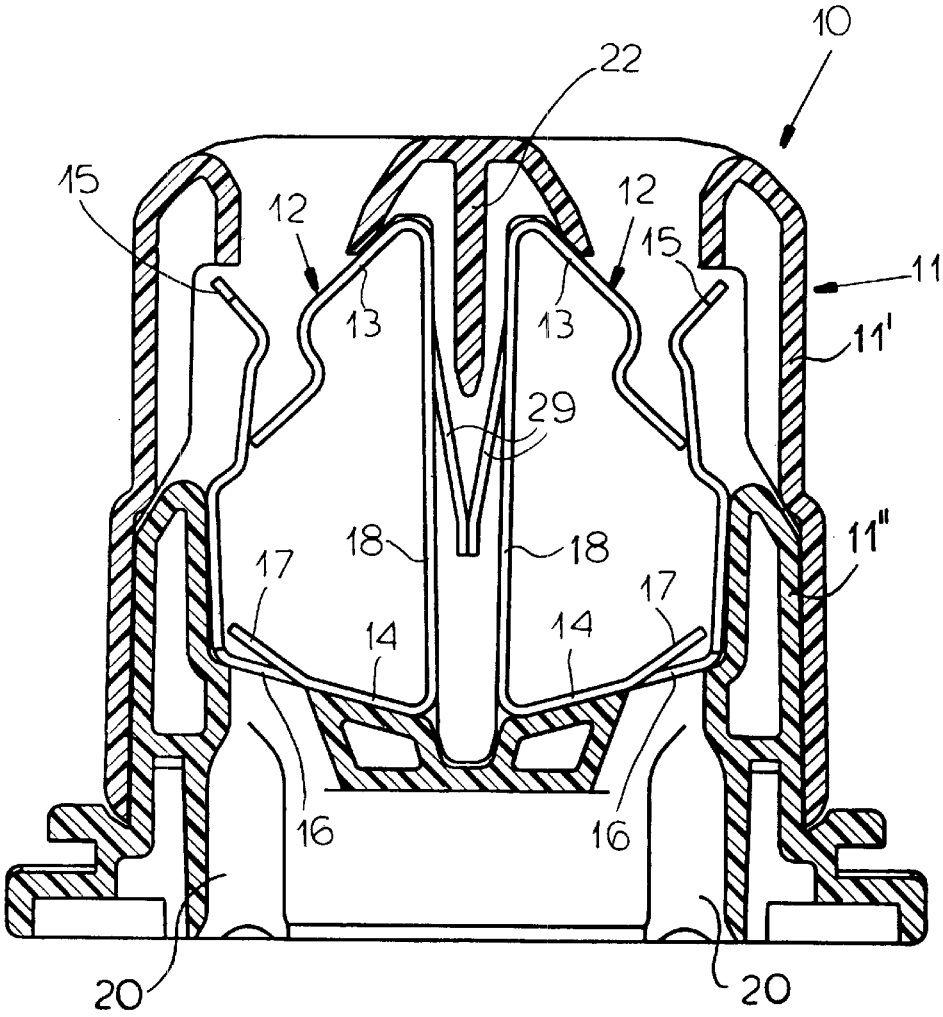
FIG. 5 is a sectional perspective end view of the socket of FIG. 1.

According to the invention each center part 18 is unitarily formed with a bent-out resilient tab or tongue 29 having an outer end that, in an installed position as shown in FIGS. 4 and 5, directly engages the other contact element tongue 29 with substantial force, forming a good electrical connection that permits even limited movement, for instance from thermal forces, that relatively shift the elements 12. Each tab or tongue 29 lies on a centerline of the respective element 12. A short central web 22 of the outer part 11' stops well short of the tongues 29.

Figure 6:
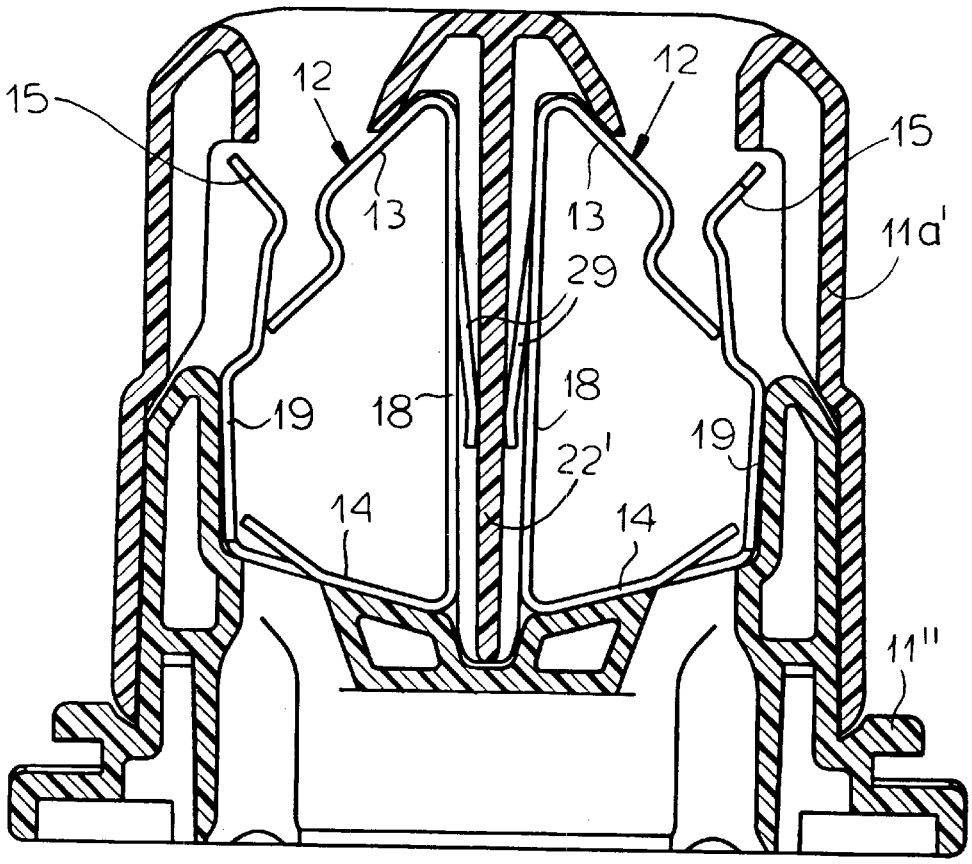
FIG. 6 is a view like FIG. 6 of a socket using the is contact elements in accordance with the invention but configured for a preheat-type lamp.

When the lamp 31 is not of the instant-start type so the two elements 12 must be electrically isolated from each other, an outer housing part 11*a'* as shown in FIG. 6 is used having a longer central web 22' which projects down between the tongues 29 to hold them apart. Thus separate connections can be made to the two elements 12 for energizing an end filament of the bulb fitted to them.

Figure 8:
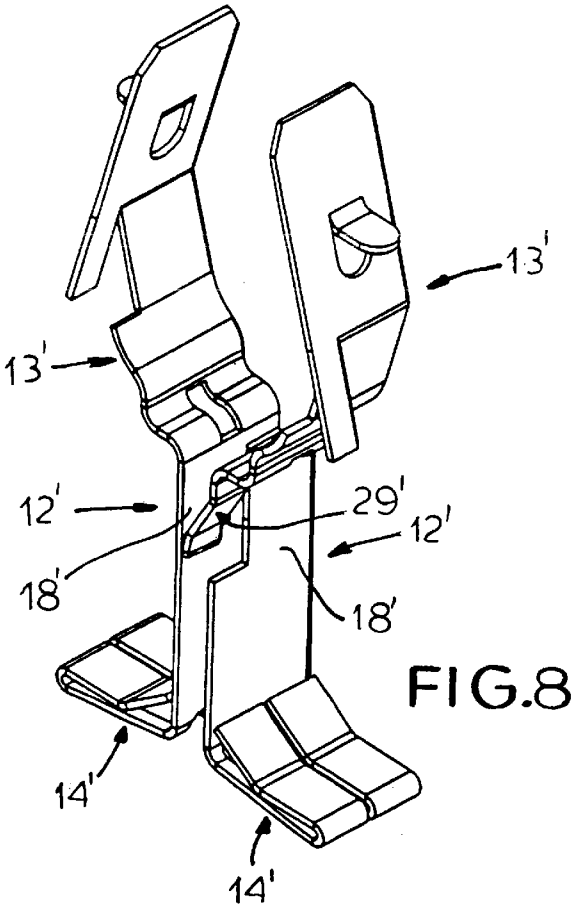
FIGS. 7 and 8 are perspective views of two further contact elements according to the invention.
Figure 7:
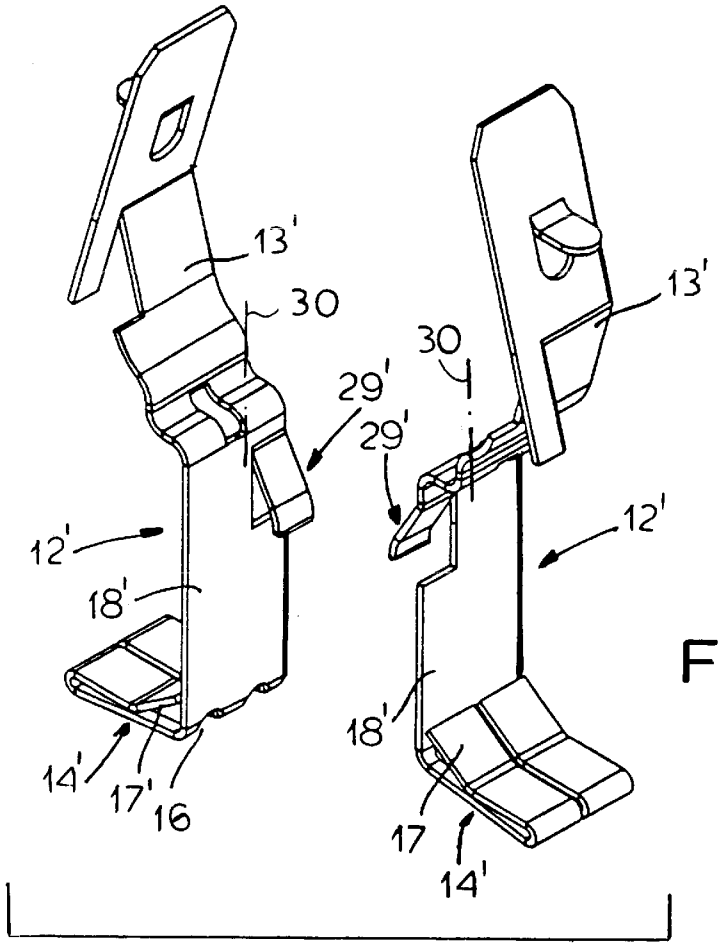

FIGS. 7 and 8 show another pair of contact elements 12' which are identical but whose tongues 29' are offset from a centerline 30 so that they directly engage the parts 18' joining single clip ends 17' and outer parts 13' when that is needed. When the tongues 29' need to be held apart, an appropriately shaped dielectric housing web fits between them as in FIG. 6.

We claim:

1. In combination:

a pair of identical conductive contact elements each unitarily formed with an outer lamp-contacting end adapted to engage a respective pin of the lamp, an inner wiring end formed as a wire-engaging clip, a center part extending between the respective inner and outer ends, and an elastic tongue unitarily formed with the respective center part and projecting transversely toward the other contact element;

a first housing part having a first housing web holding the pair of contact elements;

a second housing part fittable with the first housing part and having a web projecting between and holding the tongues out of contact with each other; and a third housing part fittable with the first housing part holding the contact elements such that the tongues engage each other and electrically interconnect the contact elements.

2. A fluorescent-lamp socket comprising:

a hollow dielectric housing having a web; and a pair of identical conductive contact elements in the housing flanking and held apart by the web, each contact element being unitarily formed with an outer lamp-contacting end adapted to engage a respective pin of the lamp, an inner wiring end formed as a wire-engaging clip, a center part extending between the respective inner and outer ends, and an elastic tongue unitarily formed with the respective center part and projecting transversely toward the other contact element.

3. The fluorescent-lamp socket defined in claim 2 wherein the contact elements are formed of resilient sheet metal.

4. A fluorescent-lamp socket comprising:

a hollow dielectric housing; and a pair of identical conductive contact elements in the housing, each contact element being unitarily formed with an outer lamp-contacting end adapted to engage a respective pin of the lamp, an inner wiring end formed as a wire-engaging clip, a center part extending between the respective inner and outer ends, and an elastic tongue unitarily formed with the respective center part and projecting transversely toward the other contact element, the tongues bearing on each other and electrically interconnecting the contact elements.

5. The fluorescent-lamp socket defined in claim 4 wherein the contact elements are formed of resilient sheet metal.

6. A fluorescent-lamp socket comprising:

a hollow dielectric housing; and a pair of identical conductive contact elements in the housing, each contact element being unitarily formed with an outer lamp-contacting end adapted to engage a respective pin of the lamp, an inner wiring end formed as a wire-engaging clip, a center part extending between the respective inner and outer ends, and an elastic tongue unitarily formed with the respective center part and projecting transversely toward the other contact element, each tongue bearing on the center part of the other contact element to electrically interconnect the contact elements.

7. The fluorescent-lamp socket defined in claim 6 wherein the contact elements are formed of resilient sheet metal.

* * * * *